US005959520A

United States Patent [19]

Stelter et al.

[11] Patent Number: 5,959,520

[45] Date of Patent: Sep. 28, 1999

[54] MAGNETIC DECOUPLER

[75] Inventors: Richard E. Stelter, Fremont, Calif.; David Choit, Dix Hills, N.Y.; Thomas J. Devaney, Watchung, N.J.

[73] Assignee: Dexter Magnetic Technologies, Inc., Fremont, Calif.

[21] Appl. No.: 09/137,568

[22] Filed: Aug. 21, 1998

[51] Int. Cl.[6] ..... H01F 7/02

[52] U.S. Cl. ..... 335/306

[58] Field of Search ..... 335/284, 285–296, 335/302, 306; 24/303

[56] References Cited

U.S. PATENT DOCUMENTS 4,339,853 7/1982 Lipschitz ..... 70/57.1

*Primary Examiner*—Michael L. Gellner
*Assistant Examiner*—Raymond Barrera
*Attorney, Agent, or Firm*—Blakely Sokoloff Taylor & Zafman, LLP

[57] ABSTRACT

An improved magnetic decoupler with a magnetic field shape, strength and gradient optimized for releasing security tags, such as an antitheft device of the type described above. Due to the structure of the magnetic decoupler, it contains less ferrous material than prior art decouplers heretofore employed. Reduction in size of the magnetic decoupler, along with improved magnetic strength, derive from the magnet assembly including magnets arranged with orientations in quadrature to increase axial magnetic field gradient within the decoupler cavity by superposition of the magnetic fields of each magnet.

10 Claims, 2 Drawing Sheets

MAGNETIC DECOUPLER

BACKGROUND OF THE INVENTION

1. Field of the Invention

The present invention relates generally to magnets and in particular to an improved magnetic decoupler for use with antitheft devices, in which the magnetic decoupler comprises a plurality of magnets arranged with their magnetic orientations orthogonal to each other.

2. Description of the Related Art

With reference to FIGS. 3 and 4, a known antitheft device used, for example, in retail sales stores that sell such goods as clothing or dry goods comprises a security tag, or simply, tag, usually having the shape of a disk or other generally planar shaped object. The tag contains a proprietary material that sets off an alarm, for example, if the goods are removed from the store without first detaching the tag. The tag is commonly attached to the goods by means of a tapered pin. The pin is inserted through the goods and into one side of the tag. The length of the pin is generally greater than the thickness of the tag. The side of the tag opposite that into which the pin is inserted is provided at its center with a nipple in which the pin is accommodated, so that the full length of the pin can be inserted into the tag. The pin may have one or more circumferential grooves. The nipple contains a mechanism for gripping the pin, or engaging a groove in the pin, which mechanism is constructed so that the pin can be easily inserted into the nipple, but once inserted, cannot be withdrawn until the gripping mechanism is made to disengage the pin, or more particularly, a groove in the pin. As a result, unauthorized removal of the tag from an article by, for example, a thief, cannot be readily accomplished.

FIGS. 3 and 4 illustrate the gripping mechanism 34 of a typical antitheft device. Gripping mechanism 34 is located in nipple 38 of disk or wafer 36 and includes both a collar 40, and a core 42. Collar 40 is secured to the interior of the base portion of nipple 38 and has a conical inner surface 44. Core 42 is located within nipple 38 and has an outer conical surface 46 which is urged upward into contact with the inner conical surface 44 of collar 40 by spring 48.

A vertical bore 50 is formed in core 42 and receives the shaft of tapered pin 54 when pin 54 is inserted into nipple 38. A horizontal bore 52 is also formed in core 42 and intersects the vertical bore 50. Two ball bearings 56 and 58 are located in bore 52. When outer surface 46 of core 42 engages the interior surface 44 of collar 40, surface 44 blocks the open ends of bore 52, causing ball bearings 56 and 58 to be wholly contained within bore 52. The size of ball bearings 56 and 58 is sufficiently large to extend into vertical bore 50 and to engage one of the grooves 60 of pin 54 when the pin is located in nipple 38.

Before pin 54 is inserted into nipple 38, core 42 is in the position illustrated in FIG. 3 and ball bearings 56 and 58 extend into bore 50. When pin 54 is first inserted into nipple 38, its tapered front end contacts balls 56 and 58 and urges core 42 downward against the force of spring 48. As core 42 moves downward, ball bearings 56 and 58 are permitted to slide radially outward from the shaft of pin 54 due to the conical shape of the interior surface of collar 40. Core 42 continues moving downward until the distance between ball bearings 56 and 58 is equal to the diameter of the shaft of pin 54. At this point, pin 54 is free to move into nipple 38. As a result of the foregoing, pin 54 is free to slide into nipple 38 at the user's discretion.

Once pin 54 has been placed in nipple 38, it cannot be removed therefrom without the use of a decoupler such as magnetic decoupler 10 of the present invention. If any attempt is made to remove pin 54 from nipple 38, the shaft of pin 54 moves slightly upward until ball bearings 56 and 58 engage any one of the grooves 60 formed by pin 54. Once this has occurred, the ball bearings 56 and 58 are forced into groove 60 by the inner conical surface of collar 40 and prevent the further removal of pin 54. Accordingly, pin 54, and along with it disk 36, cannot be removed from the article by a potential thief.

In order to unlock the disk 36 and permit the removal of pin 54, nipple 38 is inserted into a cavity of a decoupler having magnetic field in the cavity that pulls core 42 downward against the forces of spring 48 until the open ends of bore 52 are no longer blocked by collar 40, as illustrated in FIG. 4. As a result, the ball bearings 56 and 58 are free to move outward from vertical bore 50 in response to an upward tug on pin 54, allowing the pin 54 to be easily removed from the disk 36.

What is needed, then, is an improved magnetic decoupler that provides for removal of the antitheft device by a sales clerk or the like when the article is purchased. The magnetic decoupler should include a cavity into which the nipple is inserted, and a permanent magnet structure of suitable design that provides a strong, highly focused, mostly vertical magnetic field in the cavity. The axial magnetic field gradient within the cavity should force the gripping mechanism in the nipple to disengage from the groove, allowing removal of the pin from the tag.

BRIEF SUMMARY OF THE INVENTION

Disclosed is an improved magnetic decoupler with a magnetic field shape, strength and gradient optimized for releasing a security tag, such as in the antitheft device of the type described above. Due to the structure of the magnetic decoupler, it contains less ferrous material than prior art decouplers heretofore employed. Reduction in size of the magnetic decoupler, along with improved magnetic strength, derive from the magnet assembly including magnets arranged with orientations in quadrature to increase the axial magnetic field gradient within the decoupler cavity by superposition of the magnetic fields of each magnet.

Increased magnetic field intensity and magnetic field gradient permits the improved magnetic decoupler to release security tag mechanisms with less ferrous material than heretofore employed. This makes possible the use of security tags that cannot be released by prior art detachers.

BRIEF DESCRIPTION OF THE SEVERAL VIEWS OF THE DRAWINGS

For the purpose of illustration of the invention, there is shown in the drawings an embodiment. It is to be understood, however, that the invention is not limited to the particular arrangements or geometric ratios shown. Other geometric ratios have demonstrated greater detaching forces than those required by antitheft devices available today. Other magnet arrangements employing magnets arranged with their orientations in quadarature have demonstrated less, but adequate decoupling, or detaching, forces. Thus, the embodiment of the present invention is illustrated by way of example and not limitation in the accompanying figures, in which.

DETAILED DESCRIPTION OF THE INVENTION

The present invention relates to an improved magnetic decoupler for use with antitheft devices. The magnetic decoupler comprises a plurality of magnets arranged with their magnetic orientations orthogonal to each other to increase the axial magnetic field gradient within a cavity formed by the magnetic decoupler by superposition of the magnetic fields of each magnet. In the following description, numerous specific details are set forth in order that a thorough understanding of the present invention is provided. It will be apparent, however, to one of ordinary skill in the art that the present invention may be practiced without these specific details. In other instances, well-known structures, materials, and techniques have not been shown in order not to unnecessarily obscure the present invention.

Quadrature Magnets

Magnets arranged in "quadrature" (hereafter "quadrature magnets" or "quadrature magnet assembly") are arranged so that the magnetic orientation of each magnet is orthogonal to that of its neighbors, providing an important performance improvement in applications utilizing magnet assemblies depending on the flux density. Quadrature magnets result in greater force to weight ratio in Lorenz force applications and even greater improvements in force applications depending on magnetic attraction or repulsion, i.e., where force is proportional to flux density squared. Quadrature magnets also provide improved magnetic field shapes in applications where, as in the present application, optimal flux density gradients are desired.

A quadrature magnet assembly was not possible before the introduction of "square" magnet materials. Square magnet materials are those with essentially a straight line in the second quadrant of the hysteresis curve, where the intrinsic coercivity value (as measured in Oersteds) exceeds the value of residual induction (as measured in Gauss). Magnets made of ferrite, Samarium Cobalt, and Neodymium Iron are currently the most popular materials of this type. Prior to the introduction of these materials it was impractical to use a quadrature magnet assembly because each magnet in the assembly would demagnetize its neighbor to some extent when its induction exceeded the intrinsic coercivity of its neighbor.

Individual magnet geometry is a major factor in selecting an application in which a quadrature magnet assembly is used because the individual magnet geometry establishes the operating point of the magnet. Individual magnet geometry establishes the self demagnetizing factor of the magnet. Intrinsic coercivity minus the value of the self demagnetizing field determines the value of the external demagnetizing field the magnet can withstand without permanent loss of field strength. Magnetic circuit geometry determines the overall effectiveness of a group of magnets and ferrous components arranged to work together.

Detailed Description

Figure 1:
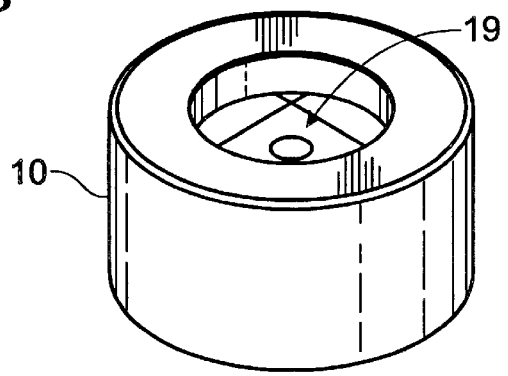
FIG. 1 is an assembly view of an embodiment of the magnetic decoupler of the present invention.
Figure 2:
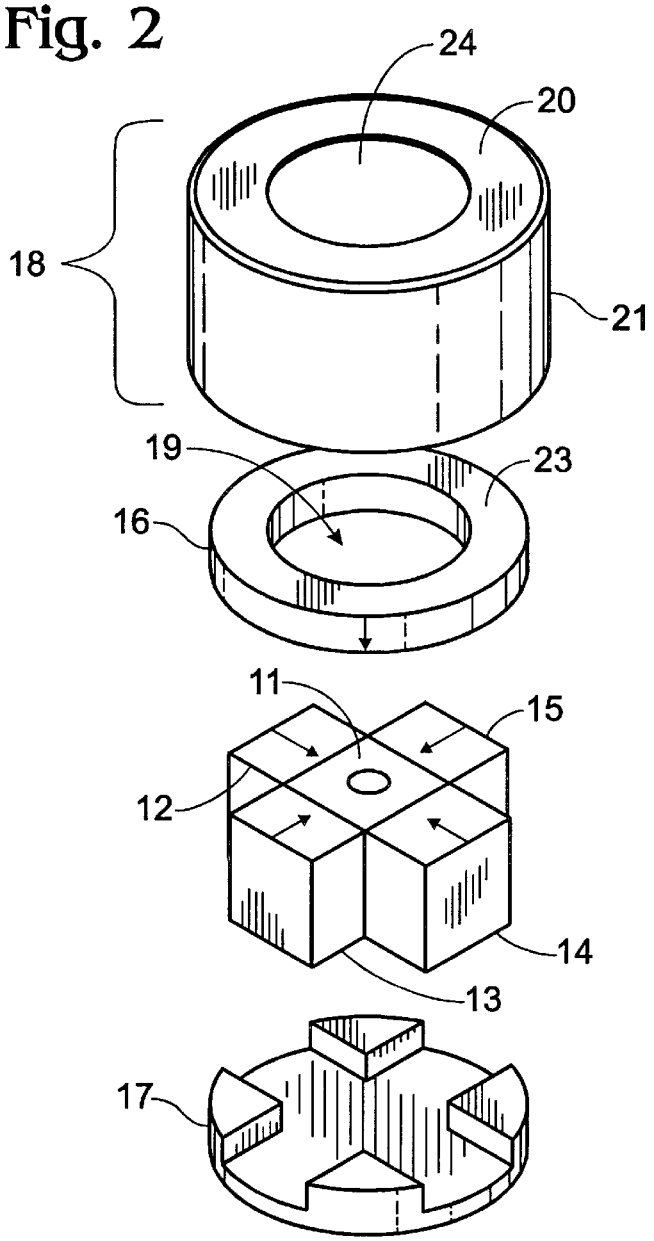
FIG. 2 is an exploded view of an embodiment of the magnetic decoupler of the present invention.

According to the present invention, a powerful permanent magnet having an axial magnetic flux density gradient greater than 55 Tesla per meter along the desired flux path is provided. With reference to FIGS. 1 and 2, one component of the magnet assembly is a high coercivity ring shaped, or annular, permanent magnet 16 having a bore 19 of sufficient diameter to accommodate, e.g., the nipple 34 of a security tag. The magnet assembly further comprises a cruciform arrangement of powerful high coercivity permanent magnets 11, 12, 13, 14 and 15 with magnetic orientations arranged in "quadrature". Optimum dimensions may be obtained through numerical analysis. However, a working model, described herein, provides outer corners of the magnets in the cruciform magnet assembly that approximate the outer diameter of the annular magnet 16. The diagonal dimension of a central magnet 11 of the cruciform magnet assembly, a parallelepiped-shaped magnet with a square cross section normal to its magnetic axis, approximates the inner diameter of the annular magnet 16 defined by bore 19.

The annular magnet 16 and cruciform assembly are aligned coaxially and are in contact with each other, as illustrated in FIG. 1. The polarity of the central magnet 11 is opposite to that of the annular magnet 16 so that flux lines in the annular aperture defined by bore 19 proceed from the face of the central magnet through the bore of the annular magnet to the distal, or opposite, face 23 of the annular magnet. The four additional magnets of the cruciform magnet assembly are parallelepiped magnets 12, 13, 14 and 15, that abut the annular magnet 16 and the central magnet 11 with polarities radial to the central magnet and normal to that of both the annular and the central magnet, as illustrated in FIG. 2. These four magnets are hereinafter collectively referred to as radial magnets. Each of the radial magnets is positioned so the face abutting the central magnet approximates the polarity at the interface of the central magnet and the annular magnet.

A steel base 17 with features matching the cruciform magnet assembly provides mechanical positioning and a path for flux fringing from the joints between magnets in the cruciform magnet assembly. A steel cup 18 with a hole 24 in its flat end 20 approximating the inner diameter of the annular magnet 16, defined by bore 19, is fitted to the magnet assembly comprising the annular magnet, the cruciform magnet assembly, and the steel base. The flat end 20 contacts the distal face 23 of the annular magnet remote from the cruciform magnets, arranged in quadrature, to further concentrate and focus the lines of magnetic flux from the distal face of the annular magnet into the bore of the annular magnet 16. The wall 21 of the steel cup 18 contains stray magnetic flux to provide some degree of magnetic shielding for the magnetic decoupler assembly.

When the antitheft device is to be unlocked, the nipple 34 is placed in the cavity defined by the hole 24 in the steel cup and the inner diameter of the annular magnet 16 defined by bore 19, and the strong magnetic field gradient therein causes the gripping mechanism of the tag to disengage from the pin 54, or the groove 60 of the pin. The action is the same as in a magnetic separator wherein the magnetic field gradient along the pin induces a magnetic field in the pin with the same polarity as the inducing field. The polarity at the end of the pin approaching the central square magnet is then opposite in sign to that on the face of the central square magnet to establish a strong attractive force.

As a result of the above described arrangement of magnets, flux lines leaving the surface of central magnet 11 nearest the bore 19 of annular magnet 16 pass through the bore of and return to the distal surface of annular magnet 16. The flat end 20 of the cup shaped steel shell 18 abuts on the distal face 23 of annular magnet 16 to concentrate and focus flux lines from the distal face of the annular magnet into the bore formed by the hole in the flat end of the cup and the inner diameter of annular magnet 16.

The hole in the steel cup and the inner diameter of the annular magnet form a bore or cavity 19 of sufficient size to accommodate the nipple 34 of the antitheft device with which the magnetic decoupler is to be used and into which the security tag nipple is inserted for unlocking. Flux from the distal face 23 of annular magnet 16 passing through the ring shaped pole piece formed by the flat end of the steel cup to the proximate face of central magnet 11 via the bore 19 can be thought of as being squeezed toward the center of the bore 19. The magnetic flux in the bore 19 due to the superposition of the fields of individual magnets, as a result, is extremely strong and is almost completely vertical in the area of the pin 54.

Figure 3:
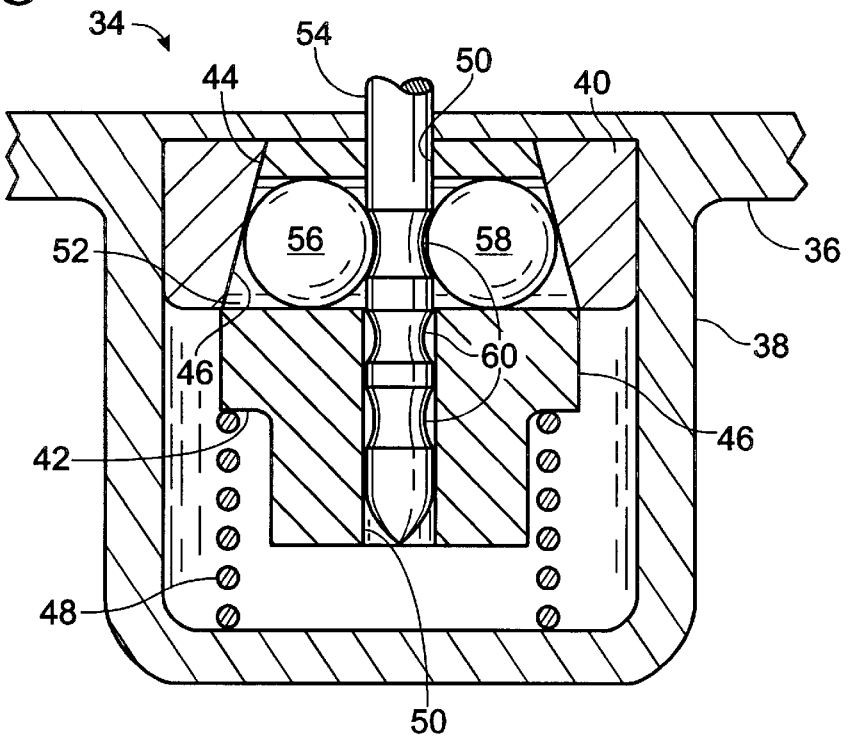
FIG. 3 is a sectional view of the gripping mechanism of the antitheft tag device in which the tag is shown engaging the tapered pin.
Figure 4:
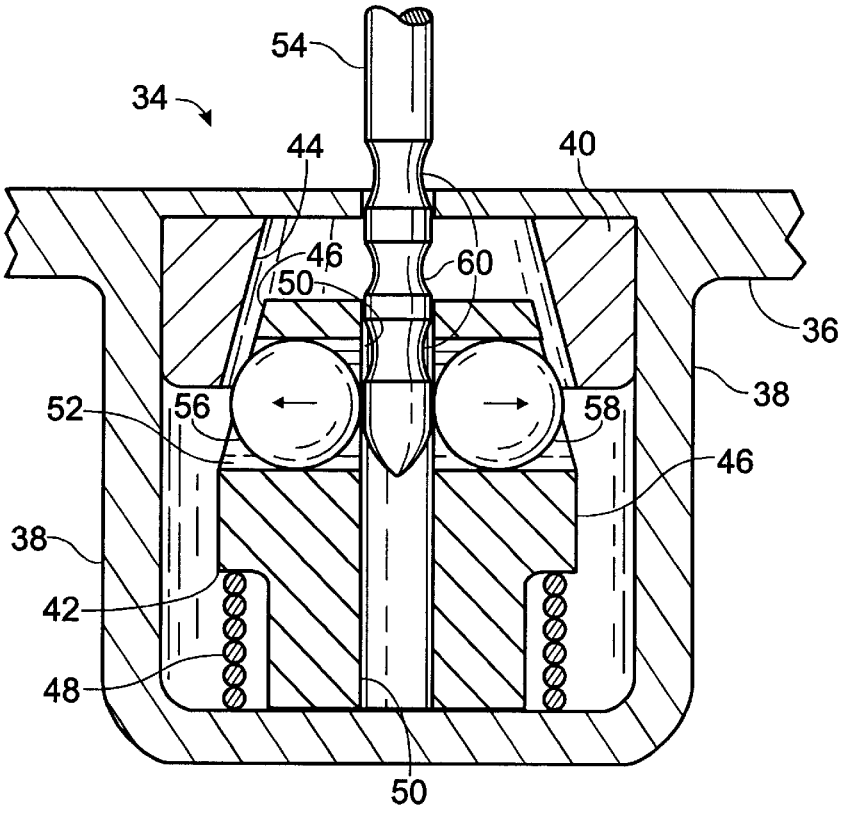
FIG. 4 is a sectional view of the gripping mechanism of the antitheft tag device in which the nipple of the antitheft tag is inserted in the bore of the magnetic decoupler of the present invention to retract the gripping mechanism, allowing the pin to be removed from the tag.

The gripping mechanism in the nipple of the antitheft disk 36 can be unlocked only by being subjected to a strong magnetic force acting along the pin axis (in the orientation of FIGS. 3 and 4). A force component acting perpendicularly to this direction not only is useless, but appears to hinder the unlocking of the gripping mechanism 34. When the nipple 38 of the disk 36 is inserted in the cavity 19, therefore, a magnetic flux with as strong a vertical gradient along the axis of pin 54 (in the orientation of FIG. 3), and as weak a horizontal component, as possible must be provided.

By superposition of the magnetic fields of radial magnets 12, 13, 14 and 15 on central magnet 11, flux density in the magnetic decoupler cavity is maximized on the face of central magnet 11 proximate to annular magnet 16. This maximizes the axial flux density gradient to exert maximum attractive force on the core 42 of the gripping mechanism to move it downward, away from core 40, so that ball bearings 56 and 58 disengage the groove, thereby allowing for removal of the pin. The attractive force is proportional to the product of the field intensity in the cavity 19 of the magnetic decoupler, which is proportional to the intrinsic flux density of the magnet material used, and the field induced in the pin 54. As the ferrous components of the security device becomes smaller, and therefore, magnetically weaker, the magnetic field provided by the decoupler magnet assembly must increase to compensate. The high field and field gradient produced by the magnet arrangement described herein allows the use of less ferrous material in the core and/or collar, etc., of the security device than heretofore possible; this smaller core (and/or larger springs 48) foils attempts to remote the tag with simple, strong magnets.

It has been found that the magnet assembly of the invention is substantially more effective for use in unlocking newer antitheft devices than prior magnetic decouplers based on coaxial assemblies of axially oriented rare earth ring magnet and disk magnet combinations, or the composite magnet arrangement of U.S. Pat. No. 4,339,853.

There are, of course, many possible alternatives to the described embodiments that are within the understanding of one of ordinary skill in the relevant art. The present invention is limited, therefore, only by the claims presented below.

What is claimed is:

1. A permanent magnet assembly that provides a substantially uniform external magnetic field in a cavity of the assembly, comprising:

an annular shaped magnet, having an inner diameter that defines the cavity and an outer diameter, situated about a central axis and that generates a first external magnetic field;

a central magnet, coaxially aligned with the annular shaped magnet, having an outside dimension that approximates the inner diameter of the annular shaped magnet, the central magnet generating a second external magnetic field of opposite polarity to the first external magnetic field;

a plurality of magnets that abut the central magnet, and the proximate face of the annular shaped magnet, the plurality of magnets having an outside dimension that approximates the outer diameter of the annular shaped magnet, and a magnetic field orientation normal to the first and second external magnetic fields to form a magnetic circuit that generates an axially aligned, substantially uniform magnetic field in the cavity.

2. The permanent magnet assembly of claim 1, further comprising a steel base upon which the plurality of magnets is situated.

3. The permanent magnet assembly of claim 1, further comprising a steel shell surrounding the annular magnet, the plurality of magnets, and the steel base to reduce fringing flux.

4. The permanent magnet assembly of claim 1, wherein the central magnet is a parallelepiped shaped magnet.

5. The permanent magnet assembly of claim 4, wherein each of the plurality of magnets is a parallelepiped shaped magnet such that the plurality of magnets abut the central magnet in a cruciform arrangement.

6. The permanent magnet assembly of claim 1, wherein the annular shaped magnet is a high coercivity permanent magnet.

7. The permanent magnet assembly of claim 1, wherein each of the plurality of magnets is a high coercivity permanent magnet.

8. The permanent magnet assembly of claim 1, wherein the central magnet is a high coercivity permanent magnet.

9. A magnet assembly, comprising:

an annular magnet having a proximate and distal, substantially flat, face and a bore extending between the faces about a central axis, the distal face defining a first pole of the annular magnet having a first polarity, the proximate face defining a second pole of the annular magnet having a second, opposite polarity;

a central magnet, coaxially aligned with the annular magnet, having a proximate and distal, substantially flat, face, the distal face defining a first pole of the central magnet having a first polarity, the proximate face defining a second pole of the central magnet having a second, opposite polarity;

a plurality of radial magnets that abut the central magnet, each having a magnetic field orientation normal to the central axis, and a polarity that provides for a magnetic circuit that generates a substantially uniform magnetic field substantially aligned with the central axis in the bore.

10. A magnet assembly, comprising:

an annular magnet having a proximate and distal face and a bore extending between the faces about a central axis, the distal face defining a first pole of the annular magnet having a first polarity, the proximate face defining a second pole of the annular magnet having a second, opposite polarity;

a central magnet, coaxially aligned with the annular magnet, having a proximate and distal face, the distal face defining a first pole of the central magnet having a first polarity, the proximate face defining a second pole of the central magnet having a second, opposite polarity;

a plurality of magnets that abut the central magnet to provide a cruciform arrangement of magnets, each of the plurality of magnets having a polarity normal to that of the central magnet;

the annular magnet and the cruciform arrangement of magnets situated relative to each other such that the annular magnet serves to both focus and add to the flux lines of the cruciform arrangement of magnets and such that the flux lines extend between the proximate face of the central magnet and the distal face of the annular magnet along a path which passes through the bore of the annular magnet in a direction substantially parallel to the central axis to provide a strong, uniform magnetic field in the bore.

* * * * *